United States Patent [19]

Kaldenbach

[11] 4,409,747

[45] Oct. 18, 1983

[54] DIGGING APPARATUS

[75] Inventor: Willem P. Kaldenbach, The Hague, Netherlands

[73] Assignee: Panama Overseas Shipping Corporation Inc., Willemstad, Netherlands Antilles

[21] Appl. No.: 185,817

[22] Filed: Sep. 10, 1980

[30] Foreign Application Priority Data

Sep. 13, 1979 [NL] Netherlands ..... 7906840

[51] Int. Cl.[3] ..... E02F 5/06

[52] U.S. Cl. ..... 37/69; 37/86; 37/DIG. 16; 405/159

[58] Field of Search ..... 37/69, 60, 66, 86, 83, 37/80 A, 80 R, DIG. 16, 90, 91, 94, 97, 191 R, 191 A, 192 R, 192 A; 405/159–163

[56] References Cited

U.S. PATENT DOCUMENTS

| | | | |
|---|---|---|---|
| 1,846,902 | 2/1932 | Powell | 37/DIG. 16 |
| 3,206,877 | 9/1965 | Metailler | 37/90 |
| 3,590,589 | 7/1971 | Smolders | 37/69 X |
| 3,722,224 | 3/1973 | Roy | 405/163 |
| 4,301,606 | 11/1981 | Hofmeester | 37/66 |

FOREIGN PATENT DOCUMENTS

| | | | |
|---|---|---|---|
| 2905540 | 8/1979 | Fed. Rep. of Germany | 405/163 |
| 2905608 | 8/1979 | Fed. Rep. of Germany | 405/161 |
| 1235790 | 6/1971 | United Kingdom | 37/60 |
| 1399802 | 7/1975 | United Kingdom | 37/65 |
| 2015619 | 9/1979 | United Kingdom | 37/66 |
| 2015620 | 9/1979 | United Kingdom | 37/66 |
| 156489 | 4/1962 | U.S.S.R. | 37/91 |
| 642439 | 1/1979 | U.S.S.R. | 37/94 |

*Primary Examiner*—Clifford D. Crowder
*Attorney, Agent, or Firm*—Ladas & Parry

[57] ABSTRACT

An apparatus for digging a trench under a pipeline or cable which has been placed on the sea bottom. A carriage moves along the pipeline. Two forward digging chains are mounted on the carriage so as to be disposed on each side of the pipeline, and so that their ends define two points on a line extending beneath the pipeline or cable. The digging chains are arranged one behind the other in the direction of movement of the carriage. Each digging chain is movable from a first position of incline with respect to the direction of movement of the carriage to a second position substantially at right angles thereto. The digging chains are shaped and positioned so as to dig the trench with an undercut slope at both sides.

9 Claims, 4 Drawing Figures

DIGGING APPARATUS

BACKGROUND OF THE INVENTION

The present invention relates to a digging apparatus with the aid of which pipelines and cables can be placed in a trench in the sea bottom after the pipeline or cable has already been placed on the seabottom. This trenching is necessary to prevent damage, such as that caused by the trawler boards of fishing boats, which are dragged along the sea bottom.

When selecting the digging method one should first note a difference between burying in a sea bottom consisting substantially of sand, and in a sea bottom consisting substantially of clay. Furthermore the depth at which the sea bottom is located plays an important part in the selection of the digging method. As trenching takes place along very large distances, it is possible that the composition of the sea bottom will vary and may consist of clay and of sand.

Prior to the present invention, in shallow water, where the sea bottom generally consisted of sand, a digging method was used, in which water jets and an air displacement caused by pressurized air supplied by tubes from a working ship are used, and in which the sand torn from the bottom was thus discharged. Such a digging method may be implemented with a horse-shoe like apparatus which includes a sledge, which is displaceable along the sea bottom, and which apparatus is placed over the pipeline or cable to be buried. At both sides of the pipeline jet pipes extend into the sea bottom and flush the sand loose. As a consequence there is a resulting air displacement ("air lift") and the torn sand torn away from under the pipeline is discharged. A trench is thus created as the sledge is displaced. The pipeline is placed in the trench after some length of trench is formed, the length being dependent on the flexibility of the pipe. After a caving in of the slope of the dug trench the pipeline is buried to some extent and by the gradual silting as a consequence over the tide flows the covering of the pipeline is gradually increased in depth. As a consequence of the rather small coherence of the sand bottom the caving in of the slope of the trench may have take place already before the pipeline is on the trench bottom, so that the pipeline will not be deep enough in the trench, or is locally uncovered. Furthermore the pipeline may break because it is curved, and locally either not supported or poorly supported.

In water which is deeper than 100 meters it is different to supply pressurized air and water by means of tubes from the working ship and therefore electricity is supplied to the digging machine to drive the underwater pumps placed thereon. In this case, a method of burying the pipeline by means of fluidizing, during which no soil displacement takes place, is preferred, because such method does not require the supply of pressurized air.

When digging a trench in a clay bottom the above mentioned method is not suitable, as for this method considerably larger capacities are required. A significant obstacle is the problem of removing the soil directly under the pipeline, caused by the high coherence of the clay.

SUMMARY OF THE INVENTION

In order to overcome the disadvantages of the known methods, an apparatus is suggested according to the invention which can be used to dig a trench under a pipeline or cable, that has previously been placed on the sea bottom. The apparatus comprises a carriage operable from a working vessel and displaceable on the sea bottom and bridging the pipeline, and a plurality of drivable digging chains at both sides of the pipeline to be buried, which are placed in the configuration of a V (so that their ends define two points on a line extending beneath the position of the pipeline or cable) and are arranged one behind the other on the carriage in the direction of movement thereof. The digging chains are disposed so as to be almost perpendicular to the direction of movement of the carriage the lower ends of the digging chains intersect each other in a vertical plane, extending through the pipeline or cable to be buried.

BRIEF DESCRIPTION OF THE DRAWINGS

The invention will now be elucidated on the basis of an embodiment, in which.

DETAILED DESCRIPTION OF THE PREFERRED EMBODIMENT

Figure 1:
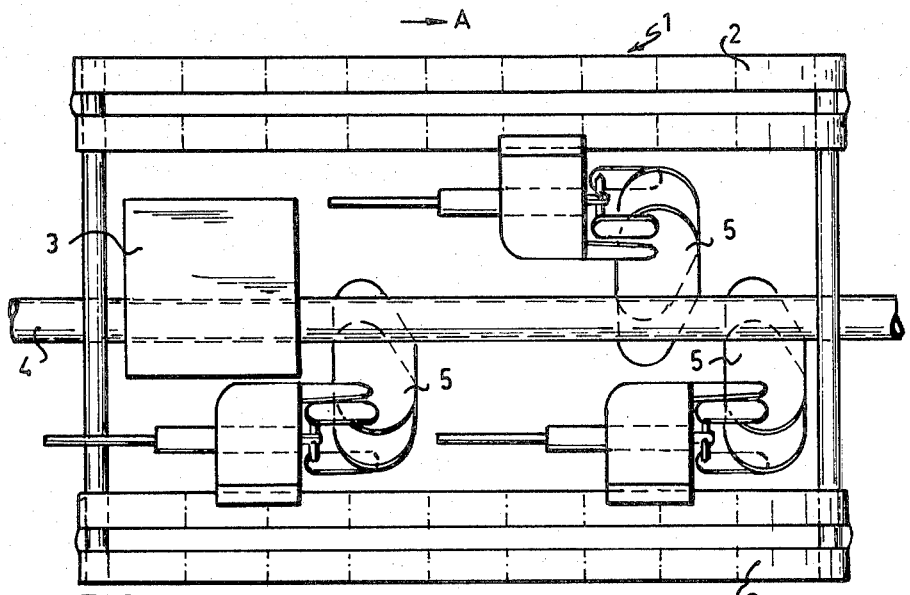
FIG. 1 shows a plan view of the present apparatus.
Figure 2:
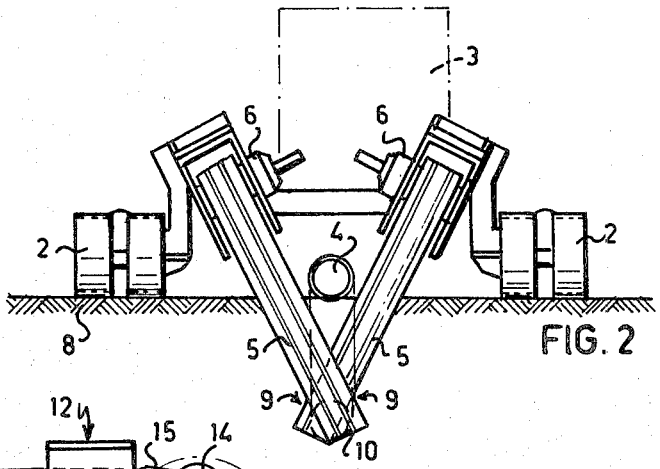
FIG. 2 shows a front view of the apparatus as shown in FIG. 1.
Figure 3:
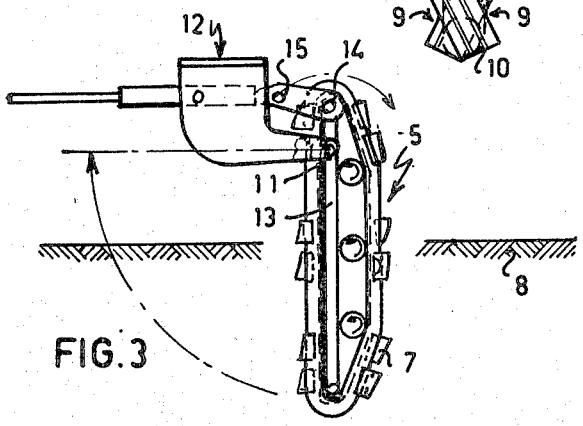
FIG. 3 is a side view of the digging chain used in the apparatus.
Figure 4:
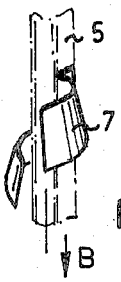
FIG. 4 shows a detail of the digging chain.

The present digging apparatus comprises a carriage 1, provided with tracks 2 and a driving compartment 3 containing means to drive the carriage, the carriage moving over the sea bottom 8 in the direction of the arrow A. The control of the driving compartment 3 takes place from a working ship. As FIGS. 1 and 2 illustrate, a plurality of digging chains 5 is located one behind the other in the configuration of a V as noted above on the carriage. As FIG. 2 illustrates in particular the carriage moves astride across the pipeline 4 to be buried and the digging chains 5 are located so that the outer ends thereof define two points on a line extending parallel to and beneath the line 4 to be buried. Each digging chain 5 is driven by a motor 6. The digging beam 13 of the digging chain 5 is suspended at the location 11 from a piston-cylinder unit 12, whereas the piston of said piston-cylinder unit is connected via a hinged arm 15 to the upper end 14 of the digging beam 13, so that the digging chain can be fixed in a swinging manner according to the indicated arrows in a certain angular position relative to the vertical. As FIG. 4 indicates in particular, the digging chain is provided with digging claws 7, which are arranged along the chain in a staggered manner and are formed somewhat conically. A plurality of digging claws forms a group, in which the width of the digging claws, seen in the direction of movement B of the digging chain, increases gradually to a width which defines the final width of the dug trench. A milling action is developed due to the gradual increase of the width of the digging claws. After the widest claw, which determines the width of the trench, there follows a plurality of claws again, starting with a small width until finally the full width is achieved again.

As the diameter of the upper chain wheel, rotating about a shaft at the location of 14, is chosen as small as possible, a self-cleaning action of the claws is achieved at a large chain speed, because when the chain rotates about this chain wheel a very large centrifugal force is developed, which strongly swings the clay out of the claws. Interruption of the digging operations and the need to clear the digging claws, which would be most disadvantageous when working at a large depth, is thus avoided.

Furthermore, because the digging apparatus is almost perpendicular to the direction of movement of the entire apparatus only a small drive power is necessary to move the digging apparatus forward. As the digging method is a mechanical one, the efficiency is many times larger than in case of a hydraulic digging method, which is particularly important for the under water applications.

The two leading digging chains 5, viewed in the direction of movement A of the digging apparatus, are disposed with respect to the pipeline 4 such that a trench is developed with a V-shaped bottom 10. This slope bottom 10, developed at both sides of the digging chains 5, is gapped or undercut at the locations 9. The soil directly under the pipeline 4 and not touched by the digging chains, falls downwardly in the formed trench. This soil is ground by one or more digging chains, arranged in the configuration of a V behind the two leading digging chains. As the process takes place under water the quickly rotating chains and digging claws cause a strong flow of water in an upward direction; This flow of water propels the ground soil upwardly and thus a clean trench is formed. After some length of trench has been formed, (the length being dependent of the flexibility of the pipeline) the pipeline will gradually be displaced into the trench along its entire length.

As mentioned above the cross-section profile of the trench will be developed with a gap or undercut of the slope at the bottom of the trench at both sides at the locations 9. A correct choice of the depth of this gap or undercut will cause the slopes cave in after some time, and thus cover the pipeline and protect it from possible damage. The final width of the trench remains narrow however.

The water flow, caused by the quickly rotating digging chains, as noted above, can also be used to bury the pipeline in a sand bottom. The sand, mechanically torn free by the chains, is kept in a fluidised condition by the flow of water for some time. In order to maintain the fluidised bed for some time, a flexible tube is disposed in the trench, the tube being provided with openings from which water flows. Thus the pipeline is allowed to sink into the trench and is buried after consolidation of the fluidised bed. Thus the yield, is considerably improved, as the fluidisation takes place mechanically again. Furthermore, in order to maintain the bed in its fluidised condition, only small quantities of water and pressures are necessary for a short period of time.

As the present digging apparatus is suitable for digging a trench both in clay and in sand, the apparatus provides important advantages. For in tracks, where both sand and clay bottoms are found, one can work continuously with one and the same machine, without expensive interruptions for a change of type, as was previously necessary, when the composition of the soil of the sea bottom changed.

What is claimed is:

1. An apparatus for digging a trench under a pipeline or cable which has been placed on the sea bottom, the apparatus comprising a carriage, means for moving the carriage along the pipeline on the sea bottom and two forward digging chains, each digging chain being movable from a first position so as to be inclined with respect to the direction of movement of the carriage to a second position so as to be substantially at right angles to the direction of movement of the carriage, at least one of the digging chains being disposed on each side of the pipeline to be buried and extending at an angle under the pipeline and to the other side thereof, the digging chains being mounted on the carriage at their upper ends so that their lower ends define two points on a line extending beneath the pipeline or cable and so that at least a portion of the lower end of each chain extends laterally beyond the other chain when viewed in the direction of the trench, the digging chains being arranged one behind the other in the direction of movement of the carriage, whereby a trench with an undercut slope at both sides is dug.

2. An apparatus as claimed in claim 1, further comprising at least one further digging chain, arranged behind the forward digging chains in the direction of movement of the carriage, the further digging chain being for grinding and discharging any soil which falls into the trench.

3. An apparatus as claimed in claim 1, wherein the carriage is operable from a working vessel.

4. An apparatus according to claim 1 in which the line extends substantially parallel to the pipeline.

5. An apparatus according to claim 4 in which the line and a diameter of the pipeline are disposed in a common vertical plane.

6. An apparatus according to claim 1, in which the digging chains are provided with conical digging claws, arranged along the chain in a staggered manner, and wherein the cone widens in the direction of movement of the digging chains.

7. An apparatus according to claim 3, in which the digging claws of a digging chain are subdivided into groups, in which of each group the width thereof, as seen in the direction of movement of the digging chain, gradually increases to a width which defines the final width of the dug trench.

8. An apparatus according to claim 1, in which the angular position of the digging chains relative to the pipeline or cable is hydraulically adjustable.

9. An apparatus according to claim 1 in which the upper chain wheel of the digging chain has a diameter small enough so that a self-cleaning operation of the digging claws is achieved.

* * * * *